US005689890A

United States Patent [19]

Glesser

[11] Patent Number: 5,689,890

[45] Date of Patent: Nov. 25, 1997

[54] GRIP SURFACE

[75] Inventor: Louis S. Glesser, Golden, Colo.

[73] Assignee: Spyderco, Inc., Golden, Colo.

[21] Appl. No.: 651,666

[22] Filed: May 21, 1996

[51] Int. Cl.[6] ..... B26B 1/10

[52] U.S. Cl. ..... 30/340; 16/110 R; 81/177.1; D22/118; 30/155

[58] Field of Search ..... 30/340, 155, 158, 30/526; 16/110 R; D7/642, 664, 649; D22/118; 81/177.1, 459; 273/73; 473/300, 303

[56] References Cited

U.S. PATENT DOCUMENTS

| | | | |
|---|---|---|---|
| D. 280,287 | 8/1985 | Collins | D8/98 |
| D. 333,251 | 2/1993 | Glesser | D8/99 |
| D. 344,006 | 2/1994 | Glesser | D8/98 |
| 4,308,762 | 1/1982 | Jannard | 16/110 R |
| 4,393,539 | 7/1983 | Weissman | 30/340 X |
| 5,502,895 | 4/1996 | Lemaier | 30/158 |

FOREIGN PATENT DOCUMENTS

| | | | |
|---|---|---|---|
| 2495986 | 6/1982 | France | 81/177.1 |

*Primary Examiner*—Douglas D. Watts
*Attorney, Agent, or Firm*—Sheridan Ross P.C.

[57] ABSTRACT

A device having a surface which is adapted to be gripped by a user wherein the surface reduces slippage at the user's hand. The surface geometry of the handle portion substantially reduces slippage that can occur when an instrument is in use. Preferably, the hand held instrument is a knife. The surface of the handle is covered with protuberances having angled planar upper surfaces which create a plurality of edges designed to minimize hand slippage.

24 Claims, 7 Drawing Sheets

GRIP SURFACE

BACKGROUND OF THE INVENTION

1. Field of the Invention

The present invention relates to a surface having a plurality of protuberances which are adapted to reduce slippage in multiple directions of, for example, a user's hand gripping the surface. The present invention is particularly useful for instruments such as hand-held knives or tools where slippage of a user's hand can cause injury.

2. Description of Related Art

Hand-held devices, such as knives or other tools, typically include a working portion (e.g. a blade) and a handle portion that is adapted to be gripped by the hand of a user so that the working portion can be manipulated. One problem associated with such devices is that slippage of the device can occur when excessive force is applied by the user to the device or when the user's grip on the handle loosens. Such slippage can seriously injure the user or others in the vicinity of the user.

Some hand-held devices are adapted to reduce slippage in one direction or have a uniform surface pattern to reduce slippage equally in all directions without consideration of the direction of applied force. However, most designs are not well suited to adequately reduce slippage in multiple directions, e.g., both the forward and backward directions.

SUMMARY OF THE INVENTION

The present invention is directed to devices that are adapted to be gripped by a hand, including hand-held devices such as knives, wherein the devices include a surface adapted to reduce slippage of the user's hand. According to one embodiment of the present invention, a device is provided which has an outer surface adapted to be gripped by the hand of a user. The outer surface includes a plurality of first discrete protuberances having at least a side portion and a substantially planar upper surface that is angled in a first planar direction relative to the outer surface. The planar upper surface and the side portion form an upper edge associated with the protuberance. The outer surface further includes a plurality of second discrete protuberances having a side portion and a planar upper surface angled in a second planar direction relative to the outer surface. The planar upper surface and the side portion format least an upper edge associated with each protuberance wherein the second planar direction is different than the first planar direction to advantageously provide slip resistance in at least two directions.

According to preferred aspects of this embodiment of the invention, the height of the upper edges increases relative to the outer surface in a direction away from a pre-selected line or point on the outer surface. Preferably, the first and second protuberances each comprise at least two upper edges and at least two opposite elongated side portions. In one embodiment, the upper planar surface is substantially trapezoidal and the upper planar surface is angled so as to form two upper edges and two opposed lower edges. The surface can be fabricated from a variety of materials including plastics and rubbers. According to another aspect, the upper planar surface is substantially in the shape of a semi-circle.

According to another embodiment of the present invention, a knife having a handle is provided. The knife includes a blade and a handle connected to the blade and adapted to be gripped by the hand of the user. The handle has an outer surface which includes a plurality of first discrete protuberances and second discrete protuberances each having planar upper surfaces. The planar upper surfaces are preferably angled in two different directions to minimize slippage of the knife in the hand of the user.

According to another embodiment of the invention, a folding knife is provided. The folding knife includes a handle having opposite elongated side portions separated by a spacer defining a cavity therebetween, wherein each of the side portions has an outer surface. The knife also includes a blade pivotally mounted on the handle and moveable between alternate positions of being stored within the cavity or being opened in an operative position. Each of the outer surfaces includes a plurality of discrete protuberances, each having a planar upper surface angled relative to the outer surface wherein the height of the upper edges formed by the planar surface increases relative to the outer surface in a direction away from a preselected line or point on the outer surface.

DESCRIPTION OF THE INVENTION

The present invention relates to a surface that is particularly useful for devices such as hand-held instruments or tools. The surface structure advantageously minimizes slippage in multiple directions, for example, as the device is used by gripping the surface (e.g., on a handle) in the hand of a user and manipulating the device. Such devices can include, but are not limited to, hand held tools such as a hammer, saw, drill, axe, sander, glue gun, high-pressure nozzle and the like, and other devices such as fishing poles, broom handles, cookware, glassware, pens and pencils, door hobs, checkbooks or steering wheels. The present invention is particularly applicable to the handle of a knife, such as a folding knife.

According to the present invention, the outer surface includes a plurality of protuberances having a shape which is adapted to minimize slippage. Preferably, the surface includes protuberances which are oriented in at least two different directions to reduce slippage in at least two different directions. The protuberances include upper surfaces that are preferably substantially planar and are angled relative to the surface to form an upper edge which advantageously reduces slippage. In a preferred embodiment, the angled surface of the protuberances providing the upper edge is angled in a planar direction on the surface of the handle to form two upper edges to provide reduced slippage in multiple directions. In another preferred embodiment, the height of the upper edges of the protuberances increases toward the outer portions of the surface of the device.

As is discussed above, the present invention is useful for a number of devices and is particularly useful for the handle of a knife, such as a folding knife. For purposes of better understanding the present invention, such a knife is illustrated in FIG. 1.

Figure 1:
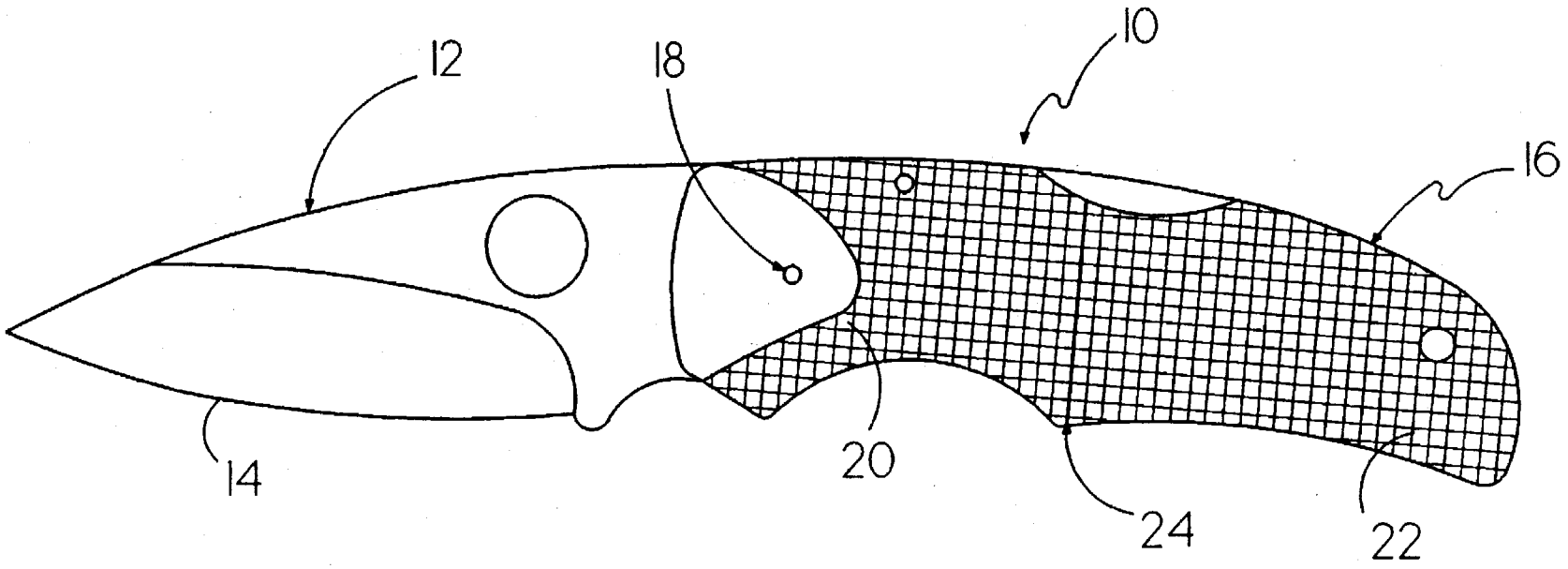
FIG. 1 illustrates a folding knife according to one embodiment of the present invention.

Referring to FIG. 1, the knife 10 includes a blade portion 12 having a sharpened edge 14 adapted for cutting. The knife 10 also includes a handle portion 16 adapted to be gripped by the hand of a user. Preferably, a clip 90 may be interconnected to the handle portion 16 of the knife 10 to permit removable attachment to an object such as a pocket or belt.

The knife 10 is a folding knife and therefore the blade portion 12 is connected to the handle portion 16 and pivots about a point 18 so that the blade portion 12 can be folded into the handle portion 16 for storage. According to the present invention, the outer surface of the handle portion 16 includes a plurality of protuberances, such as those labelled at 20 and 22, to reduce slippage of the knife 10 in the hand of the user.

Figure 2:
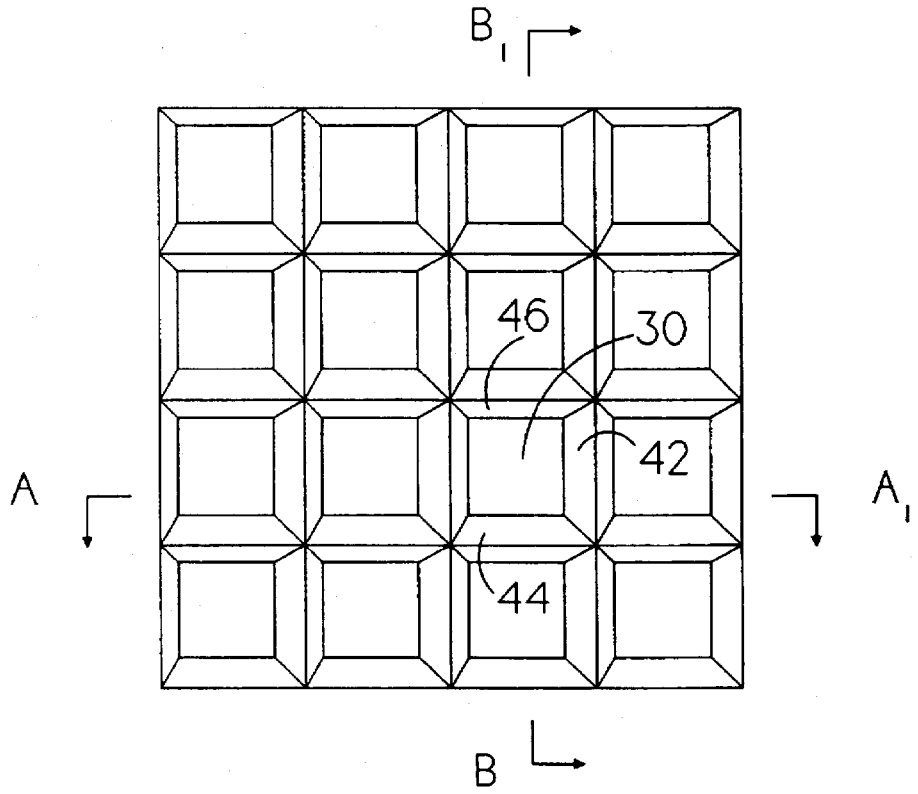
FIG. 2 illustrates the detail of the surface of according to one embodiment of the present invention.
Figure 3:
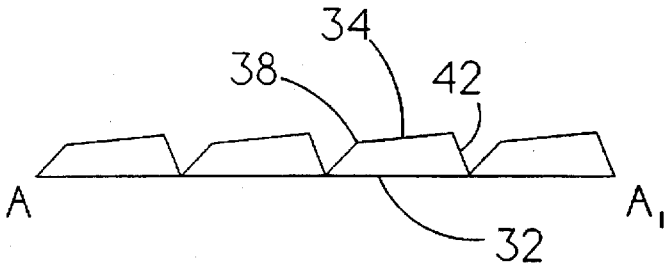
FIG. 3 illustrates a cross-section taken along line $A–A_1$ of FIG. 2.
Figure 4:
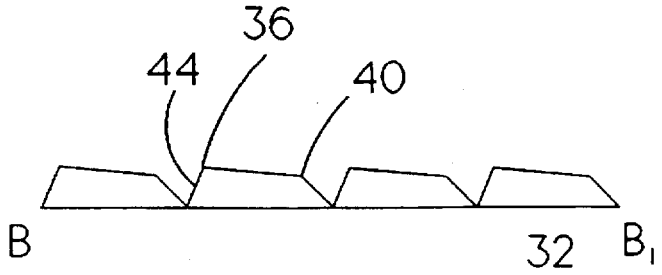
FIG. 4 illustrates a cross-section taken along line $B–B_1$ of FIG. 2.

Referring to FIGS. 2–4, a closeup view of surface protuberances according to one embodiment of the present invention is illustrated. The protuberances on the outer surface 32 include an upper planar surface 30 which is angled relative to the outer surface 32 of the handle. The term angled means that the upper planar surface 30, if extended through the outer surface 32, forms an acute angle with the outer surface 32 that is greater than 0° but less than about 90°. Preferably, the acute angle is from about 10° to about 80°. The angled upper planar surface 30 along with the side portions 42, 44 form upper edges 34, 36 and lower edges 38, 40. It will be appreciated that the planar surface may terminate on the outer surface 32, for example, such that there is no lower side portion 44 or lower edge 40.

In the embodiment illustrated in FIGS. 2–4, the upper planar surface 30 is angled relative to the outer surface 32 in such a direction as to form two upper edges 34 and 36. This is illustrated in FIGS. 3 & 4 which are cross-sections taken at lines $A–A_1$ and $B–B_1$ respectively. Thus, the hand of a user is less likely to slip when slid substantially perpendicular to either upper edge 34 or 36, which lie substantially perpendicular to each other.

Figure 5:
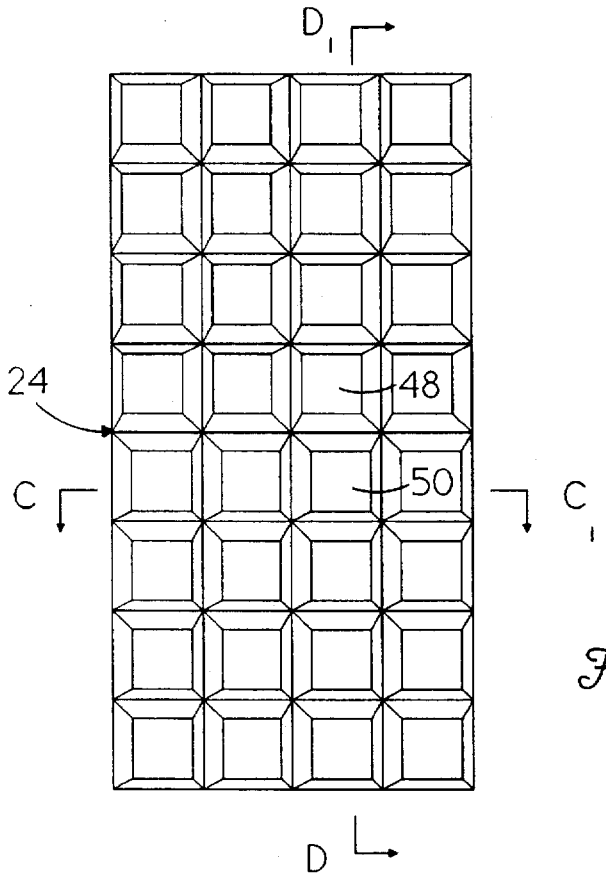
FIG. 5 illustrates the detail of the surface of according to one embodiment of the present invention.
Figure 6:
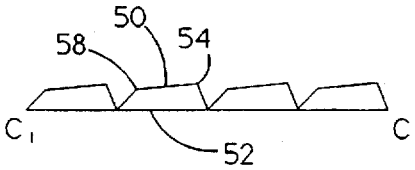
FIG. 6 illustrates a cross-section taken along line $C–C_1$ of FIG. 5.
Figure 7:
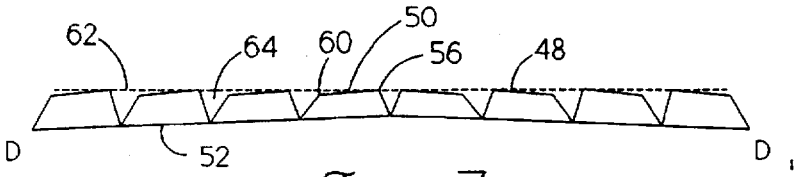
FIG. 7 illustrates a cross-section taken along line $D–D_1$ of FIG. 5.

A preferred embodiment of the invention is illustrated in FIGS. 5–7. FIG. 5 is similar to FIG. 2 and illustrates a detailed view of the surface protuberances. However, the orientation of the protuberances is reversed along an area or line, such as at 24 (also see FIG. 1). For example, this line can be preferably located at approximately the center of the device handle. Thus, the planar upper surfaces 48 and 50 are angled in different directions to provide slippage resistance in at least two different directions and likely, all four possible directions.

FIG. 5 illustrates a view of the surface protuberances taken from above the handle. The protuberances include an upper planar surface 50 that is angled relative to the outer surface 52. The upper planar surfaces form upper edges 54, 56 and lower edges 58, 60.

As is illustrated in FIG. 6, the height of the protuberances from the top to bottom (along line $C–C_1$) of the handle surface can remain substantially unchanged. However, as is illustrated in FIG. 7, the height of the protuberances relative to the outer surface 52 preferably increases moving from the line 24, for example, to the front or to the rear of the handle. However, the total height relative to an outer planar surface 62 preferably remains substantially unchanged.

Thus, according to this embodiment, the user of the instrument, due to a large number of protuberances on the surface, perceives a substantially flat grip surface 62. However, the depth of the gaps 64 between adjacent protuberances increases toward the front and rear of the handle. This progressively increases resistance to and advantageously assists in minimizing slippage of the instrument in both the forward and rearward working directions.

Figure 8:
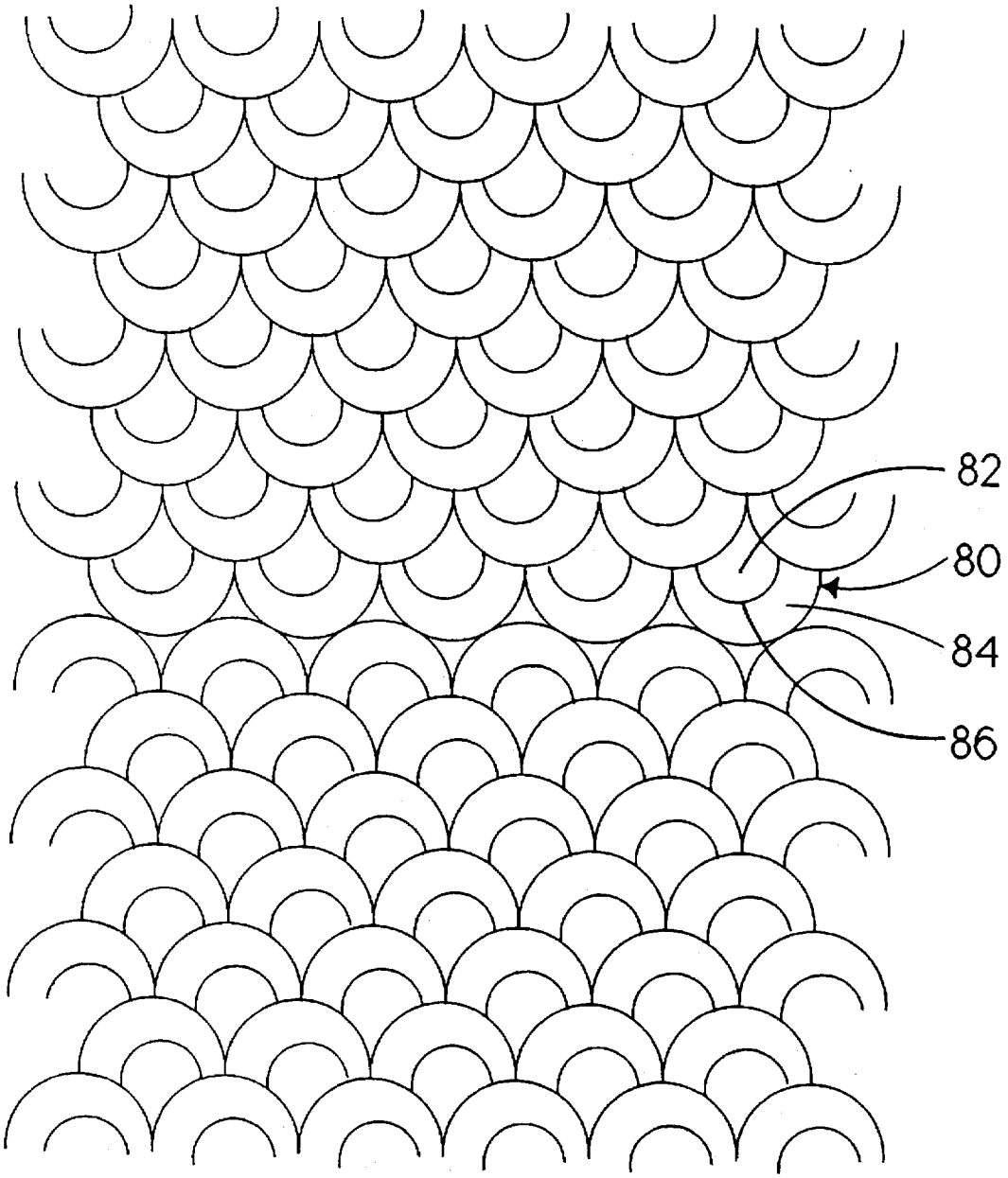
FIG. 8 illustrates the detail of the surface of according to one embodiment of the present invention.

Although illustrated in FIGS. 1–7 as being substantially rectangular, it will be appreciated that the surface protuberances according to the present invention can take a variety of shapes. For example, FIG. 8 illustrates an embodiment of the present invention wherein the protuberances are in the form of a "fish-scale" design. That is, the protuberances are in the form of semi-circles. For example, the protuberance 80 is substantially in the shape of a semi-circle. The protuberance 80 includes an upper surface 82 and a side portion 84 which form an upper edge 86. The upper edge of the protuberances is adapted to reduce slippage of the device when held in the hand of a user. As illustrated in FIG. 8, the protuberances can be oriented in different directions to reduce slippage in different directions.

Figure 9B:
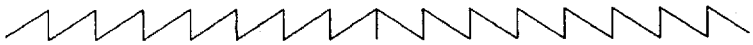
FIGS. 9A and 9B illustrate the detail of the surface of a device according to one embodiment of the present invention.
Figure 9A:
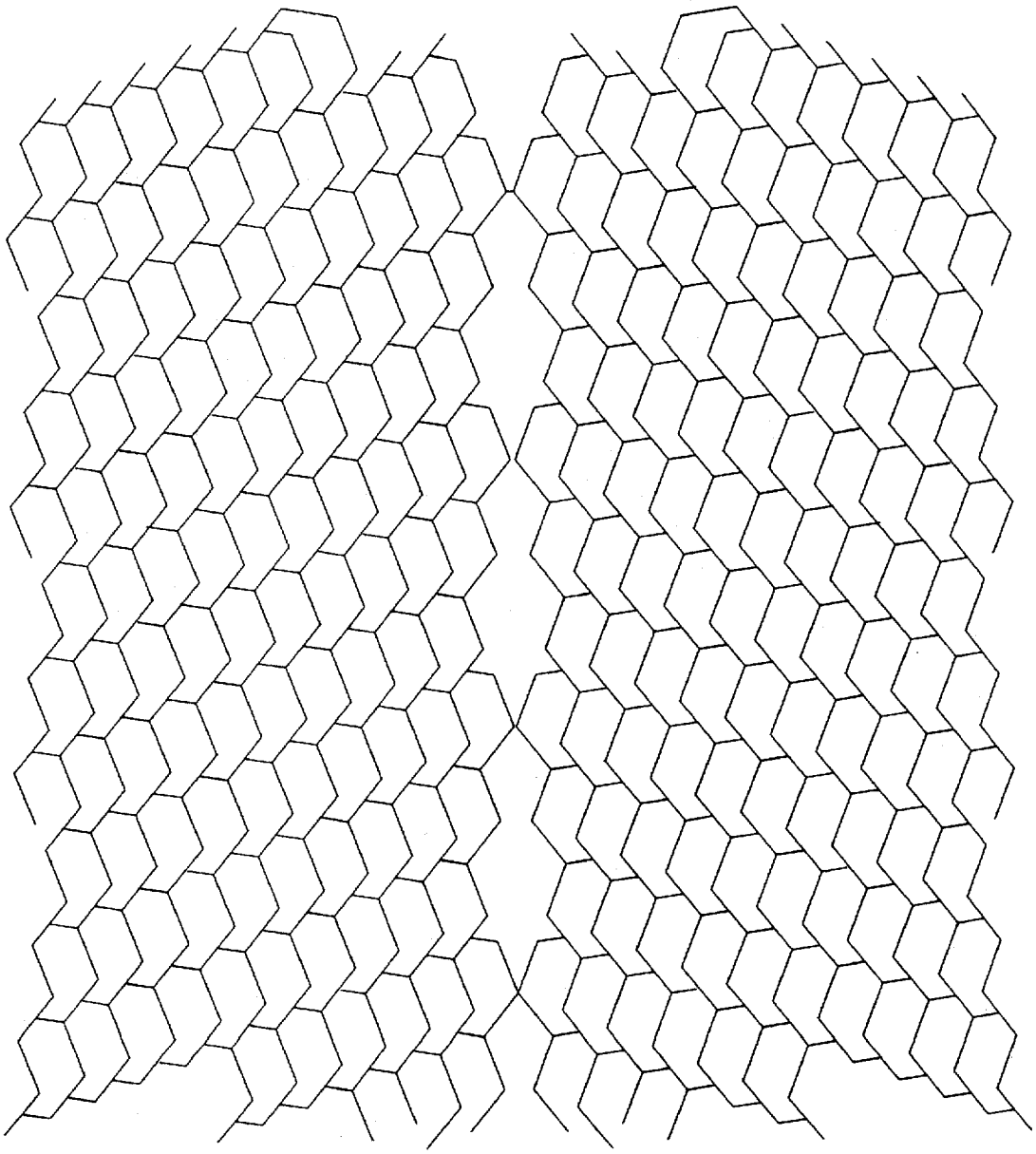

FIGS. 9A–9B illustrate an embodiment of the invention wherein the protuberances are substantially in the shape of hexagonal plates. FIG. 9A is a top view of a surface according to this embodiment of the invention. FIG. 9B illustrates a cross-section of the surface pattern illustrated in FIG. 9A.

Figure 10:
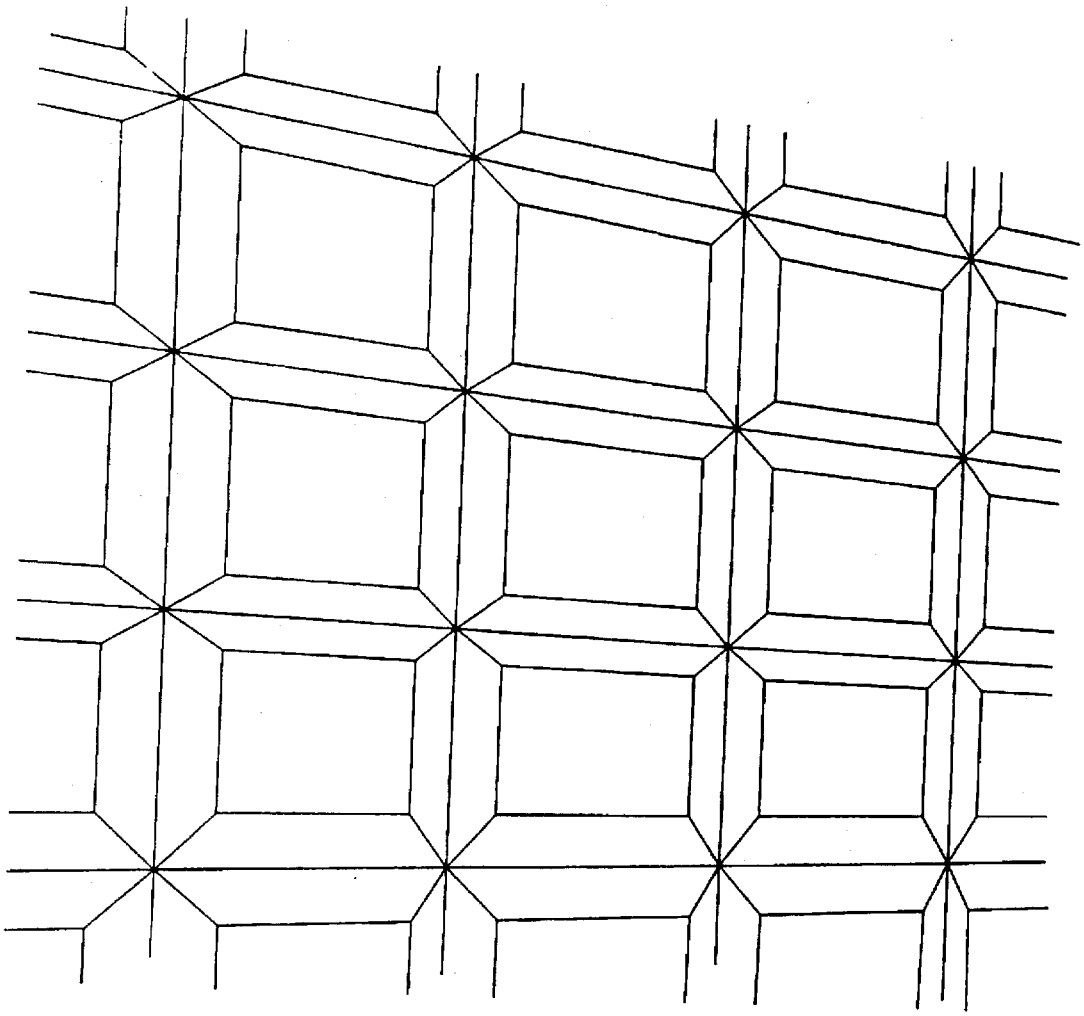
FIG. 10 illustrates the detail of the surface of a device according to one embodiment of the present invention.
Figure 11:
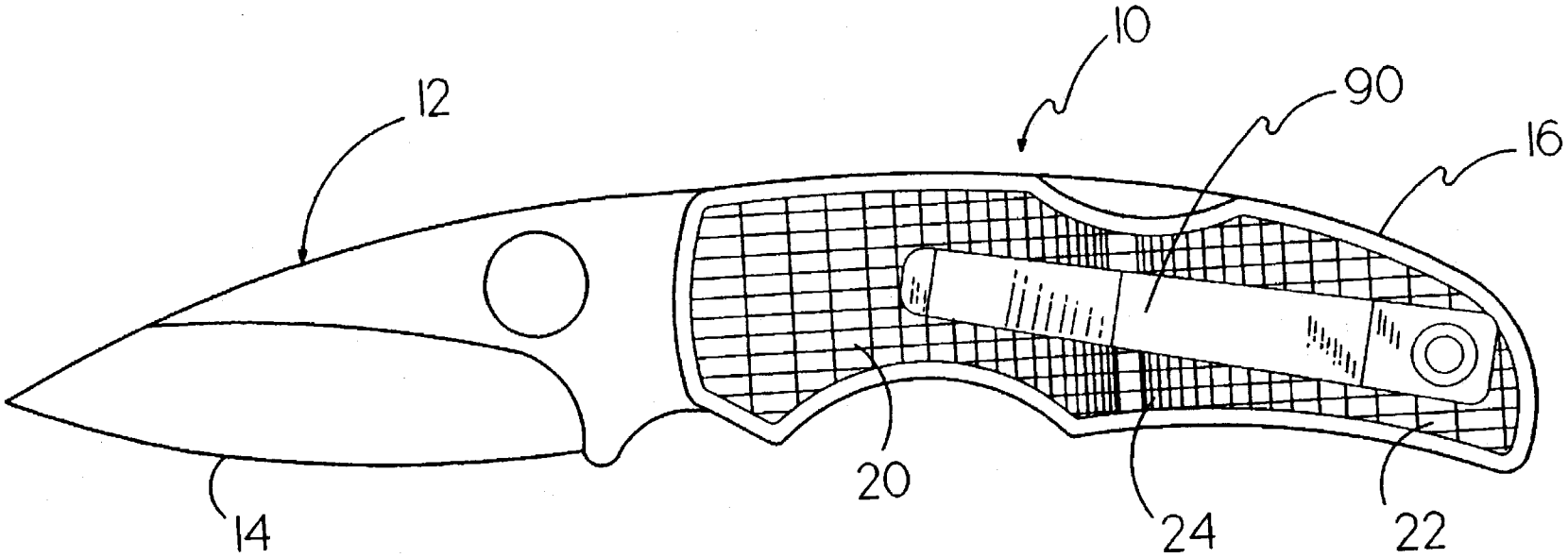
FIG. 11 illustrates a clip for the handle.

In addition, it is possible to provide the surface with protuberances in a multitude of orientations on the surface. For example, FIG. 10 illustrates another embodiment of the invention wherein the protuberances radiate, for example, from a point on the surface, rather than from a line bisecting the surface. This configuration can advantageously reduce slippage of the instrument in multiple directions.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A knife comprising an outer surface adapted to be gripped by the hand of a user, wherein said outer surface comprises:

(a) a plurality of first discrete protuberances, said first protuberances comprising at least a side portion and a substantially planar upper surface that is angled in a first planar direction relative to said outer surface, said planar upper surface and said side portion forming at least an upper edge associated with each of said first protuberances, said side portions progressively increasing in height relative to said outer surface as the distance from a preselected line or point on said outer surface increases; and (b) a plurality of second discrete protuberances, said second protuberances comprising at least a side portion and a substantially planar upper surface that is angled in a second planar direction relative to said outer surface, said planar upper surface and said side portion forming at least an upper edge associated with each of said second protuberances, said side portions progressively increasing in height relative to said outer surface as the distance from a preselected line or point on said outer surface increases wherein said second planar direction is different than said first planar direction to provide slip resistance in at least two directions.

2. A device as recited in claim 1, wherein said first and second protuberances comprise at least two upper edges.

3. A device as recited in claim 1, wherein said outer surface comprises at least two opposite elongated side portions.

4. A device as recited in claim 1, wherein said first upper planar surface is substantially trapezoidal and said upper planar surface is angled so as to form two upper edges and two opposed lower edges.

5. A device as recited in claim 1, wherein said device is a hand-held tool selected from the group consisting of a hammer, an axe, a drill, a sander, a glue gun, and a saw.

6. A device as recited in claim 1, wherein said outer surface is fabricated from a material selected from the group consisting of plastics and rubbers.

7. A device as recited in claim 1, wherein said upper planar surface is substantially in the shape of a semi-circle.

8. A knife having a handle, comprising:

(a) forwardly located blade means comprising a sharpened edge adapted for cutting;

(b) rearwardly located handle means functionally connected to said blade means and comprising an outer surface adapted to be gripped by the hand of a user; and (c) a plurality of first discrete protuberances on said outer surface, said first protuberances comprising at least a side portion and a substantially planar upper surface that is angled in a first direction relative to said outer surface, said planar upper surface and said side portion forming an upper edge associated with each of said protuberances adapted to resist the sliding force of the hand of a user, said side portions progressively increasing in height relative to said outer surface as the distance from a preselected line or point increases; and (d) a plurality of second discreet protuberances on said outer surface, said second protuberances comprising at least a side portion and a substantially planar upper surface that is angled in a second direction relative to said outer surface, said planar upper surface and said side portion forming an upper edge associated with each of said second protuberances adapted to resist the sliding force of the hand of the user in a direction different that the direction of said first protuberances, said side portions progressively increasing in height relative to said outer surface as the distance from a preselected line or point increases.

9. A knife as recited in claim 8, wherein said knife is a folding knife.

10. A knife as recited in claim 8, wherein said preselected line or point is approximately centered on said outer surface.

11. A knife as recited in claim 8, wherein said handle means comprises two opposed elongated side portions separated by a spacer defining a cavity therebetween.

12. A knife as recited in claim 8, wherein said planar upper surface is substantially trapezoidal.

13. A knife as recited in claim 12, wherein said upper planar surface is angled in a second direction to form two upper edges and two opposed lower edges associated with each of said protuberances.

14. A folding knife, comprising:

(a) handle means having opposite elongated side portions separated by a spacer defining a cavity therebetween, each of said side portions having an outer surface;

(b) blade means pivotally mounted on said handle means and movable between alternate positions of being stored substantially within said cavity or being open in an operative position as an extension of said handle; and (c) a plurality of discrete protuberances on each of said outer surfaces, said protuberances comprising side portions which support a substantially planar upper surface that is angled relative to said outer surface, said planar upper surface and said side portions forming at least first and second upper edges and first and second opposed lower edges, wherein the height of said first upper edges of said protuberances progressively increases relative to said outer surface in a direction away from a preselected line or point on said outer surface.

15. A folding knife as recited in claim 14, wherein said folding knife further comprises clip means interconnected to said handle means and adapted to slidably engage a portion of a supporting member.

16. A folding knife as recited in claim 14, wherein said preselected line or point is approximately centered on said outer surface.

17. A knife comprising an outer surface adapted to be gripped by the hand of a user, said outer surface comprising:

a multiplicity of first discrete protuberances oriented in a series of rows and columns, said rows originating at a preselected line or point on said outer surface, each of said protuberances comprising:

a substantially planar upper surface oriented in a non-parallel plane to said outer surface and interconnected to a plurality of side members extending upwardly from said outer surface, said points of interconnection of said side members and said planar upper surface defining a first and second upper edge and at least one lower edge, a portion of said first upper edge and a portion of a said second upper edge elevated above said outer surface a distance greater than said remaining lower edges, wherein said first upper edge and said second upper edge are slip resistant to a user of said knife in two distinct directions.

18. The knife of claim 17, wherein said planar upper surface is substantially trapezoidal in shape.

19. The knife of claim 17, wherein said planar upper surface is substantially rectangular in shape.

20. The knife of claim 17, wherein said first upper edge and said second upper edge are oriented at substantially right angles.

21. The knife of claim 17, wherein the distance said side members extend upwardly from said outer cover progressively increases as the distance from said preselected point increases.

22. The knife of claim 17, further comprising a multiplicity of second discrete protuberances extending in a second direction from said preselected point and further oriented in a series of rows and columns, said second discrete protuberances having the same geometric configuration as said multiplicity of first discrete protuberances.

23. The knife of claim 22, wherein said multiplicity of said first discrete protuberances and said second discrete protuberances are geometrically oriented in said rows and said columns from said preselected point to resemble a spider web.

24. The knife of claim 17, wherein said preselected point is substantially centered on said outer surface.

* * * * *